US008567377B2

(12) United States Patent
Victor

(10) Patent No.: US 8,567,377 B2
(45) Date of Patent: Oct. 29, 2013

(54) TOY PROJECTILE LAUNCHER APPARATUS

(75) Inventor: Robert James Victor, Sunnyside, NY (US)

(73) Assignee: Hasbro, Inc., Pawtucket, RI (US)

( * ) Notice: Subject to any disclaimer, the term of this patent is extended or adjusted under 35 U.S.C. 154(b) by 177 days.

(21) Appl. No.: 13/246,172

(22) Filed: Sep. 27, 2011

(65) Prior Publication Data

US 2012/0080018 A1 Apr. 5, 2012

Related U.S. Application Data

(60) Provisional application No. 61/388,370, filed on Sep. 30, 2010, provisional application No. 61/388,383, filed on Sep. 30, 2010.

(51) Int. Cl.
*F41B 7/08* (2006.01)

(52) U.S. Cl.
USPC ..... 124/27

(58) Field of Classification Search
USPC ..... 124/16, 26, 27
See application file for complete search history.

(56) References Cited

U.S. PATENT DOCUMENTS

| | | | | | |
|---|---|---|---|---|---|
| 342,893 | A | * | 6/1886 | Austin | 124/27 |
| 368,307 | A | | 8/1887 | Rhodes | |
| 961,511 | A | | 6/1910 | Marble | |
| 1,294,548 | A | * | 2/1919 | Skomars | 124/27 |
| 1,294,917 | A | | 2/1919 | Koontz | |
| 1,353,663 | A | | 9/1920 | Napier | |
| 1,374,757 | A | | 4/1921 | Napier | |
| 1,817,745 | A | | 8/1931 | Forsman et al. | |
| 2,476,212 | A | * | 7/1949 | Nitz et al. | 124/27 |
| 3,430,620 | A | | 3/1969 | Davis | |
| 3,476,100 | A | | 11/1969 | Carbonneau | |
| 3,635,204 | A | | 1/1972 | Plumb, Jr. | |
| 3,779,227 | A | | 12/1973 | Scott | |
| 3,949,731 | A | | 4/1976 | Caso | |
| 3,968,783 | A | | 7/1976 | Pfotenhauer | |
| 4,016,854 | A | | 4/1977 | Lehman | |
| 4,030,472 | A | | 6/1977 | Watkins | |
| 4,059,089 | A | | 11/1977 | Lehman | |
| 4,067,308 | A | | 1/1978 | Andersen et al. | |
| 4,170,215 | A | | 10/1979 | Kettlestrings | |
| 4,248,202 | A | | 2/1981 | Jaworski et al. | |
| 4,270,293 | A | | 6/1981 | Plumer et al. | |
| 4,335,701 | A | | 6/1982 | Bozich | |
| 4,659,320 | A | | 4/1987 | Rich et al. | |

(Continued)

OTHER PUBLICATIONS

PCT/US2011/053405—International Search Report. dated Feb. 1, 2013.

(Continued)

*Primary Examiner* — John Ricci
(74) *Attorney, Agent, or Firm* — Perry Hoffman

(57) ABSTRACT

Several variations of a toy projectile launcher apparatus for discharging EVA balls. The apparatus includes a housing, a ram movable in the housing, a carriage also movable in the housing, a negator spring, a handle for cocking the apparatus, and a lever pivotally mounted in the housing just behind a ball to be discharged. In operation, a user pulls the handle rearward and a connector engages the ram to pull the ram rearward. The ram abuts the carriage and when the ram moves rearward the carriage also moves rearward. The carriage is attached to the spring and extends the spring when the carriage moves rearward. At a predetermined location the connector disengages the ram.

20 Claims, 14 Drawing Sheets

(56) References Cited

U.S. PATENT DOCUMENTS

| | | | | |
|---|---|---|---|---|
| 4,694,815 | A * | 9/1987 | Hung | 124/27 |
| 4,714,069 | A * | 12/1987 | Ulrich | 124/26 |
| 5,224,701 | A | 7/1993 | Sciarriallo et al. | |
| 5,355,866 | A | 10/1994 | Hunter | |
| 5,471,967 | A | 12/1995 | Matsuzaki et al. | |
| 5,529,050 | A | 6/1996 | D'Andrade | |
| 5,611,322 | A | 3/1997 | Matsuzaki et al. | |
| 5,782,228 | A | 7/1998 | Wu | |
| 5,970,970 | A | 10/1999 | Vanek et al. | |
| 5,996,564 | A | 12/1999 | Kotowski | |
| 6,224,457 | B1 | 5/2001 | Wu | |
| 6,598,329 | B1 | 7/2003 | Alexander | |
| 6,733,356 | B2 | 5/2004 | Lee | |
| 7,163,009 | B2 | 1/2007 | Brown | |
| 7,287,526 | B1 | 10/2007 | Bligh et al. | |
| 7,418,797 | B1 | 9/2008 | Crose | |
| 7,437,847 | B1 | 10/2008 | Mabry | |
| 7,552,557 | B1 | 6/2009 | Mabry | |
| 7,673,624 | B2 | 3/2010 | Rosella, Jr. | |
| 7,686,002 | B2 * | 3/2010 | Andrews | 124/65 |
| 2006/0242880 | A1 | 11/2006 | Griffin | |
| 2007/0069064 | A1 | 3/2007 | Mott | |

OTHER PUBLICATIONS

PCT/US2011/053405—Written Opinion of the International Searching Authority. dated Feb. 1, 2013.

PCT/US2011/053405—Notification of Transmittal of the International Search Report and the Written Opinion of the International Searching Authority or the Declaration. Feb. 1, 2013.

PCT/US2011/53411—International Search Report. dated Feb. 21, 2012.

PCT/US2011/53411—Written Opinion of the International Searching Authority. dated Feb. 21, 2012.

PCT/US2011/53411—Notification of Transmittal of the International Search Report and the Written Opinion of the International Searching Authority or the Declaration. Feb. 21, 2012.

* cited by examiner

TOY PROJECTILE LAUNCHER APPARATUS

PRIORITY REFERENCE

This application claims priority from Provisional Patent Applications, Nos. 61/388,370 and 61/388,383, both filed on Sep. 30, 2010, which are expressly incorporated herein by reference.

FIELD OF THE INVENTION

The present invention relates generally to a projectile launcher apparatus, and, more particularly, to a toy projectile launcher apparatus that discharges a spherical-shaped projectile with good flight characteristics and distance.

BACKGROUND OF THE INVENTION

Toys and other devices that discharge projectiles have been designed in the past with various housing and internal elements. These devices are often difficult to use or even dangerous for children, or are too expensive, complicated or insufficiently robust.

Examples of prior patents include U.S. Pat. No. 4,016,854, for a "Spring Type Bottle Cap Pistol" issued in 1977 to Lehman that purports to disclose a pistol to propel and spin a bottle cap by attaching a compression spring to a plunger in a lower chamber, attaching a hammer to the plunger, where the hammer extends through a slot in a upper chamber where the bottle cap is loaded. The plunger is pulled back by a user to compress the spring and the plunger is restrained by a trigger assembly. The hammer is located off-center from the bottle cap so that when a trigger is pulled, the plunger is released and under the biasing force of the spring accelerates the hammer and bottle cap along the upper chamber to discharge the bottle cap while also inducing a spin in the cap. A restraining pin extends through a slot to abut an interior surface wall of the bottle cap to prevent the bottle cap from moving until the trigger is depressed at which time the pin moves out of the way. Another patent issued to Lehman later in 1977, No. 4,059,089 for a "Flying Saucer Launching Pistol" purports to disclose a pistol very similar to that disclosed in his earlier patent but with a pair of ramps in the firing chamber tapered so as to center different diameter discs when each is loaded.

U.S. Pat. No. 4,170,215 for a "Disk Toy And Launcher" issued in 1979 to Kettlestrings, purports to disclose a mechanical launcher for a toy disk that has a recess for engaging and bending a leaf spring when loaded. After bending the spring, the disk is received by tabs of catch members in the launcher. When a plunger dislodges the tabs the spring propels the disk away from the launcher. In 1999, a patent issued to Vanek and others for a "Ring Airfoil Launcher" U.S. Pat. No. 5,970,970, and purports to disclose a rifle for safely launching ring airfoils. The rifle includes a coil spring that is extended by a handle to cock the rifle, and a trigger to hold and release the stretched spring. A similar product for launching ring airfoils, known as the Vortex Tornado, also includes a coil spring that is extended by a rearward pulled handle but the product does not have a trigger. When the handle is retracted, pulled rearward, to a predetermined location, the airfoil is released.

These patents and devices are of some interest, however, they do not disclose or illustrate a simple, inexpensive, fun to use and robust toy item.

SUMMARY OF THE INVENTION

In accordance with the present invention, an advantageous method and various apparatus are provided in the form of a toy projectile launcher apparatus that discharges a spherical-shaped projectile. The toy launcher is easily operated, even by young children, and requires a ball to be loaded, a handle to be moved rearward to extend a constant force launch spring, and a lever to be impacted to cause the ball to be discharged. The energy from the launch spring is transferred through a carriage and a ram to the lever that in turn slaps the ball to cause ejection of the ball with a backspin. The launcher apparatus also has the advantages of being relatively simple, fun to use, safe, relatively inexpensive, compact and yet, structurally robust.

Briefly summarized, the invention relates to a projectile launcher apparatus for discharging spherical-shaped projectiles the apparatus including a housing, a handle mounted to the housing and movable between forward and rearward positions, a launch spring mounted to the housing, a lever pivotally connected to the housing for imparting discharge energy to the projectile, a carriage connected to the launch spring, a ram engagable by the handle, abutting the carriage when moving rearward, and slidably connected to the carriage when moving forward for impacting the lever and causing the lever to pivot and hit the projectile, and a connector for releasably holding the ram.

The invention also relates to a method for making a toy launcher apparatus capable of discharging spherical-shaped projectiles, the steps of the method including providing a housing, mounting a handle, a ram, a carriage, a spring, a lever and a connector to the housing, connecting the spring to the carriage, slidably mounting the ram to the carriage, placing the connector to engage the ram when the spring is extended and to disengage the ram to enable the ram and the carriage to quickly move under the influence of the spring, and placing the lever so as to be impacted by the moving ram, the impacted lever being able to rotate and slap a spherical projectile resulting in the projectile's discharge from the apparatus.

BRIEF DESCRIPTION OF THE DRAWINGS

For the purpose of facilitating an understanding of the invention, the accompanying drawings and detailed description illustrate a preferred embodiment thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
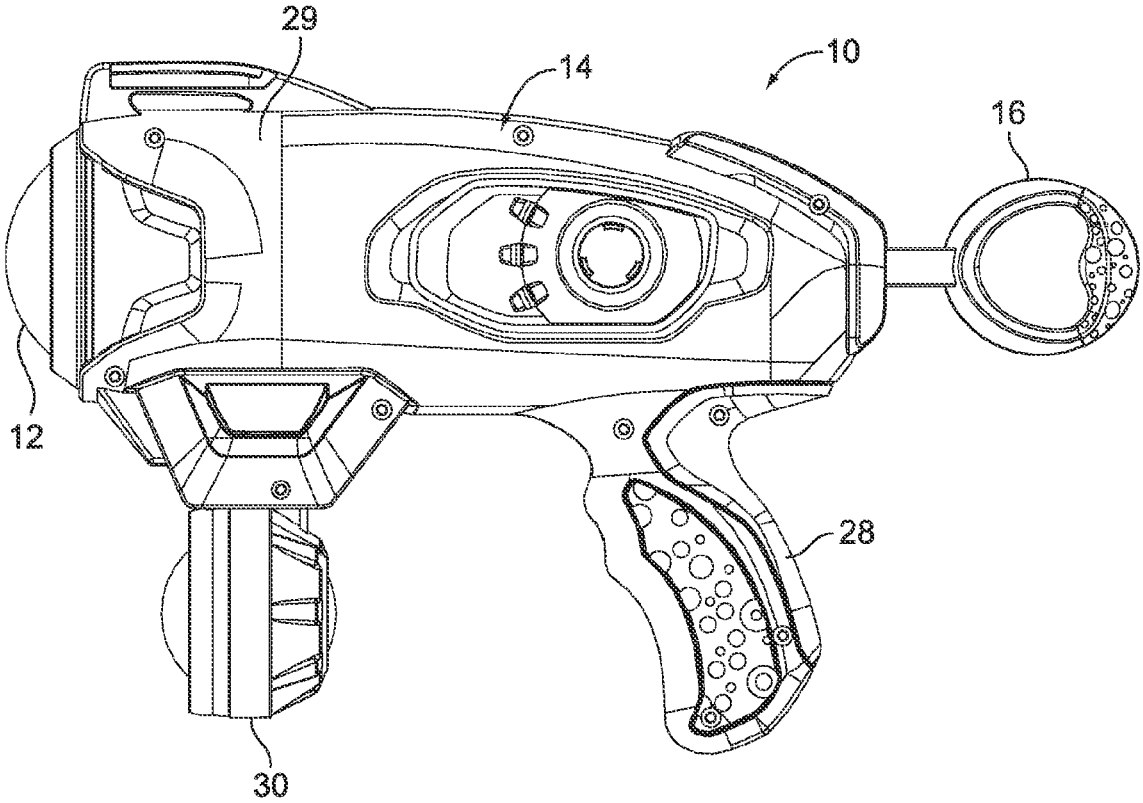
FIG. 1 is a side elevation view of a preferred embodiment of the present invention in the form of a toy projectile launcher apparatus loaded with a ball to be discharged.
Figure 3:
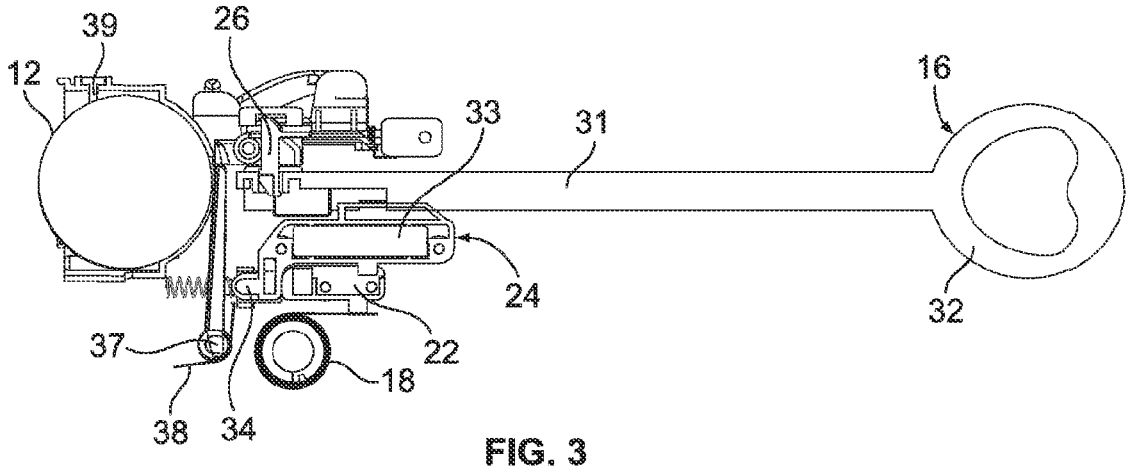
FIG. 3 is a diagrammatic side elevation view of internal elements for firing the toy projectile launcher apparatus shown in FIG. 1.
Figure 2:
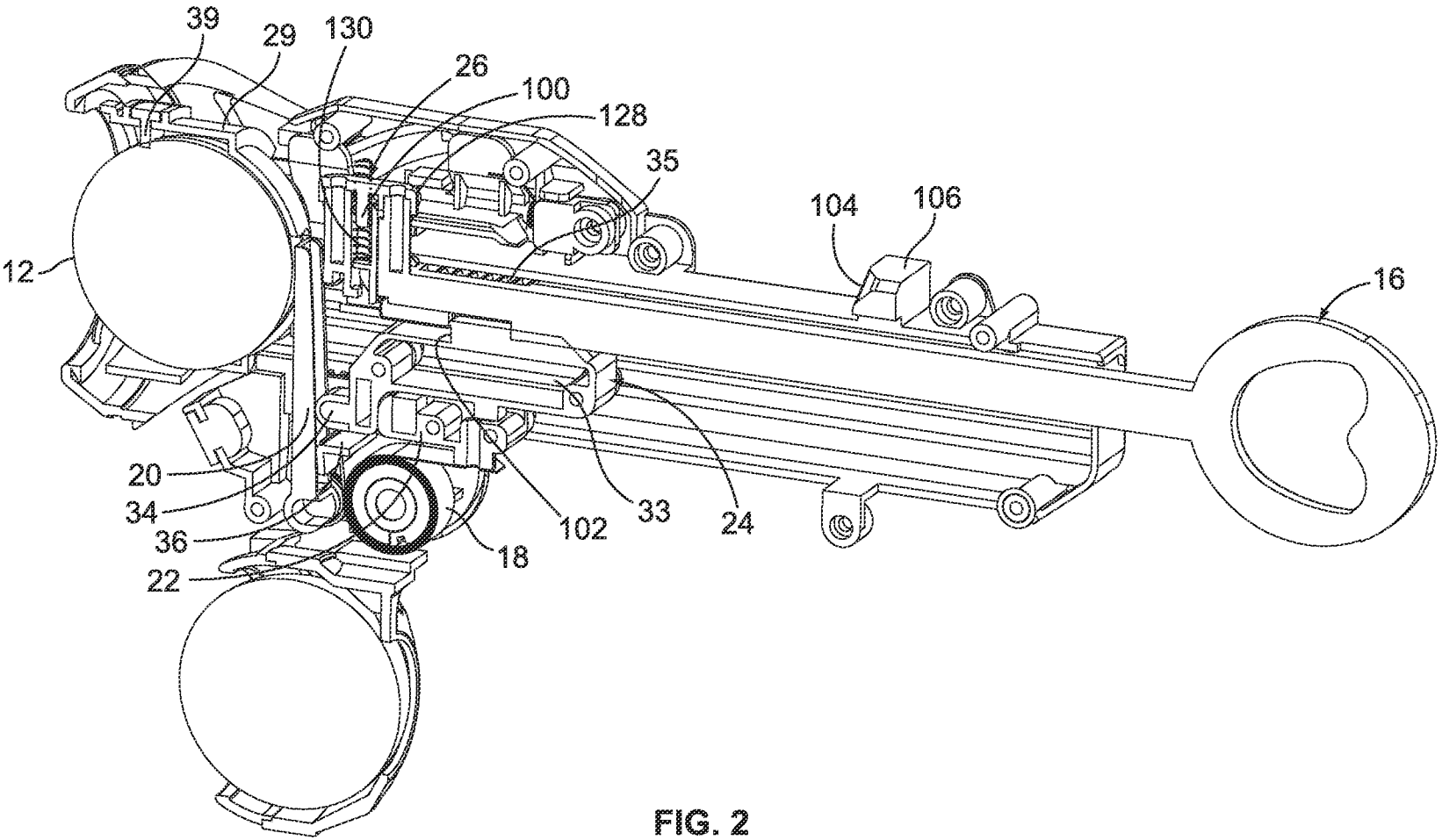
FIG. 2 is an enlarged isometric sectional view of the toy projectile launcher apparatus shown in FIG. 1.
Figure 4:
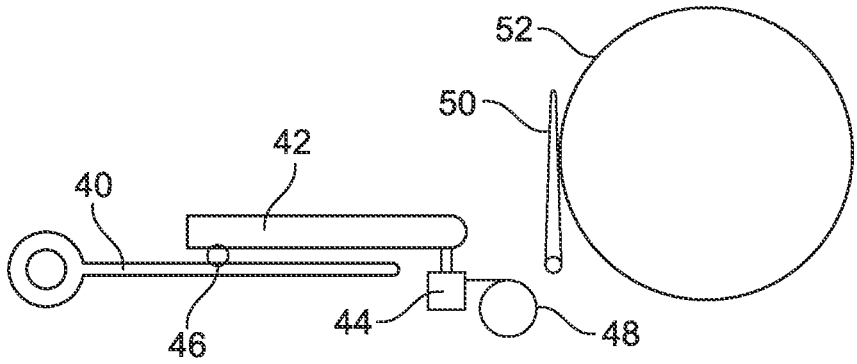
FIG. 4 is a diagrammatic side view of firing elements at rest for the toy projection launcher apparatus shown in FIG. 1-3, including a handle, a ram, a carriage, a connector, a constant force spring and a lever behind a ball to be discharged.

Referring now to FIGS. 1-3, there is shown an embodiment of the invention in the form of a toy projectile launcher apparatus 10 for discharging a spherical-shaped projectile such as a ball 12. The launcher apparatus is designed for safety reasons to prevent its use with most projectiles other than a specific ball. For example, a preferred ball is formed of ethylene vinyl acetate (EVA) having a diameter of about 45.5 to 46.5 mm and a weight of about 4.0 to 4.8 g. The toy launcher apparatus 10 includes a housing or base 14 with an internal frame, a handle 16 mounted to the housing and movable between forward and rearward positions, a launch spring 18 mounted to the housing, a lever or flap 20 pivotally connected to the housing for imparting discharge energy to the ball, a carriage 22 connected to the launch spring 18, a ram 24 and a connector 26. The ram 24 is engagable by the handle 16 and mounted to abut the carriage 22 when the ram is moved rearward by the handle, and when the ram is moved forward it is connected to the carriage to allow the ram to slide further forward relative to the carriage when the carriage stops. The extra forward motion allows the ram to impact the lever and cause the lever to pivot and hit the ball. The connector 26 releasably holds the ram. The handle, the spring, the ram, the carriage, the connector and the lever may be considered "firing elements."

Figure 5:
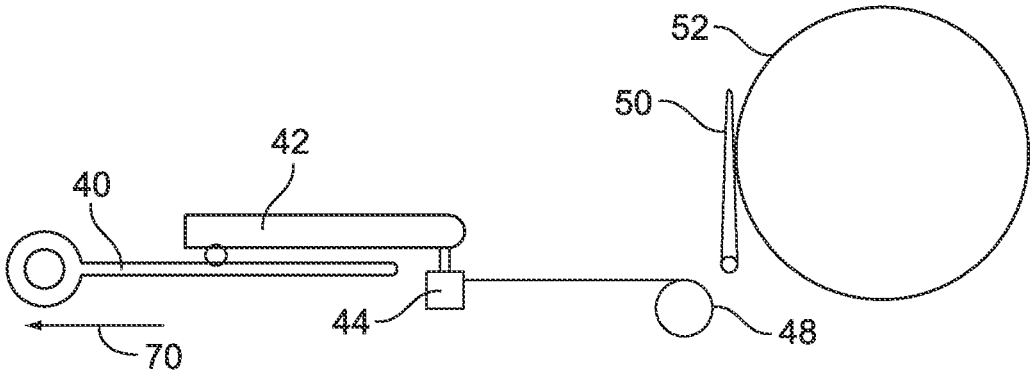
FIG. 5 is a diagrammatic side view illustrating the handle, the ram, the carriage and the connector moved rearward as a unit and the constant force spring being extended.

The housing 14 includes a grip 28 and a barrel 29, the grip enabling a user to hold and aim the launcher apparatus while easily loading and cocking the apparatus by inserting a ball in the barrel and by pulling the handle rearward, as illustrated in FIG. 5. A ball storage holder 30 may be provided beneath the barrel. The pistol configuration shown is highly stylized and may include designs of popular merchandising concepts such as "StarWars." In the alternative, the launcher apparatus may be shaped to look more like a real gun or a cannon, or some other toy figure. In another variation the apparatus may be formed as a real weapon.

Figure 6:
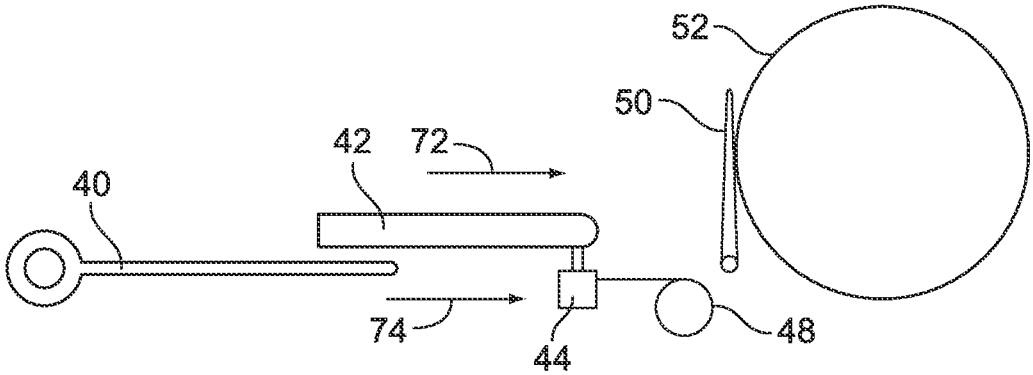
FIG. 6 is a diagrammatic side view of the ram and the carriage disconnected from the handle and being moved forward toward the lever and the ball by the constant force spring.

The handle 16 includes a rod portion 31 and a pull portion 32. The handle is operated by a user who grasps the pull portion 32 to move the handle from a forward position shown in FIG. 1, to a rearward position shown in FIGS. 5 and 6. Extending the handle also extends the launch spring 18 to provide energy to discharge the ball. In a one preferred embodiment the handle is extended rearward about four to four and a half inches to cock the apparatus. The carriage 22 is directly attached to the launch spring 18. The ram 24 is movable between rearward and forward positions and is connected to the handle by a connector 26. The ram has a body portion 33 that glides along the housing frame and a depending nose portion 34 that is located in front or forward of the carriage 22. When the ram is moved rearward by the handle the nose portion abuts the carriage and pushes it rearward. However, when the carriage and the ram are released and snapped forward by the rewinding of the launch spring that is connected to the carriage, the carriage abuts the nose portion of the ram and drives the ram forward. When the carriage comes to a halt before any contact with the lever, the body portion of the ram slides forward relative to the carriage to enable the nose portion to impact the lever.

After the handle 16 has been retracted or moved rearward to a predetermined location, the connector 26 disconnects or disengages the ram 24 from the handle 16 and the carriage and the ram snap forward under the influence of a biasing force from the launch spring 18. The handle may remain extended if held by the hand of a user and may be returned by a return spring 35 once the handle is released. In the preferred embodiment, the launch spring 18 requires about five pounds of pull force to cause extension. A bumper 36 (best seen in FIGS. 13 and 16) may be included to limit or stop the forward motion of the carriage 22 while the ram 24 is able to continue forward even though no longer connected to the launch spring due to momentum, by sliding relative to the carriage for another inch to inch and a half so as to impact the lever 20 as will be explained and illustrated in more detail below. The ram is relatively heavy and the lever relatively light so that there is a relatively large energy transfer when the ram impacts or strikes the lever and the lever hits or slaps the ball.

In the alternative, the handle may extend laterally like a rifle bolt to be gripped by a user to cock the launcher apparatus by manually moving the bolt handle to the rearward position and then manually returning the bolt handle to the forward position, and the connector may be part of a trigger assembly. When the bolt handle is extended to a predetermined distance or to a predetermined location, cocking the apparatus, the connector may engage the ram or the carriage and restrain them until a trigger is pulled, firing the apparatus.

The launch spring 18 is preferably a constant force spring, also known as a negator spring, and requires approximately a constant five pounds of pull for the spring to be extended rearward. When the spring is released there is approximately a constant five pounds of biasing force acting on the ram and the carriage during the entire forward movement. The handle may be connected to the return spring. In the alternative, a coil spring may be used as the launch spring instead of the negator spring, but operation is not as efficient or efficacious. Also, the predetermined distance may be more or less than four to four and a half inches and the spring force more or less than five pounds.

The lever 20 is rotatably mounted to move between an upstanding position shown in FIG. 2, and an impacted position shown sequentially in FIGS. 8-10, and FIG. 13, where a lever is struck by a ram and causes the lever to slap or smack a ball. Upon impact by the ram the lever rotates forward (to the right in FIGS. 8-10) to transfer energy from the ram to the ball to cause discharge of the ball. After first contact with the ball, the lever continues to rotate in contact with the ball to induced backspin. It has been found that having backspin enables the ball to travel a greater distance with the same amount of input energy. The lever is mounted to a shaft 37, FIG. 3, to which is also mounted a return torsion spring 38 that returns the lever to the upright starting position. To help increase backspin on the ball, a backspin protrusion or wiper 39 may be attached to the barrel and positioned to cause the ball to be slightly squeeze as discharge occurs. A friction force is generated in a rearward direction thereby causing the ball to increase its rearward rotation or backspin.

Referring now to FIGS. 4-10, the operation of the firing elements of the toy launcher apparatus 10, and other variations described in detail below, is illustrated in simplified diagrammatic form. The firing elements shown in FIG. 4 include a handle 40, a ram 42, a carriage 44, a connector 46, a negator spring 48, and a lever 50. The lever is located just behind a ball 52 to be discharged. The connector insures that the ram 42 moves with the handle 40 when a user pulls on the handle in a rearward direction. However, at the predetermined rearward location, the ram 42 detaches or disengages from the handle 40 and the carriage with the ram snap forward under the influence of the launch spring 48. When the carriage 44 reaches its starting position it stops but the ram 42 is able to continue forward by sliding relative to the carriage. The ram continues forward and impacts the lever 50 and thereby transfers energy from the relatively heavy and fast moving ram to the ball. In an alternative, the ram may be latched in the rearward position, the handle may return forward, and a trigger mechanism may be used to release the ram.

Figure 7:
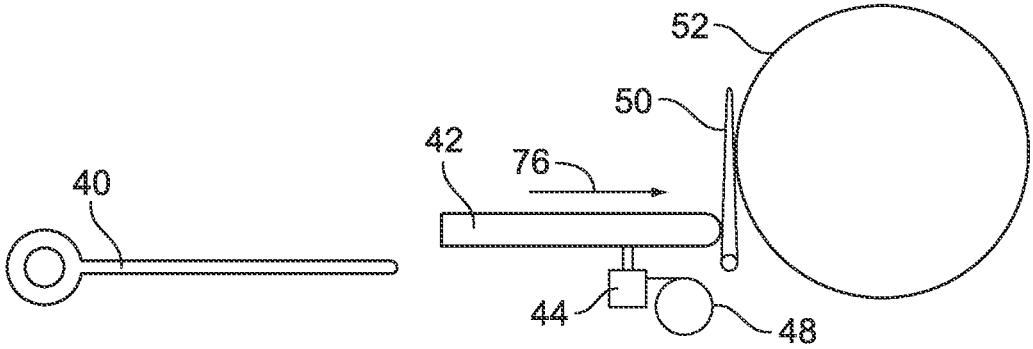
FIG. 7 is a diagrammatic side view of the ram sliding relative to the stopped carriage to impact the lever.

Referring again to FIG. 4, the firing elements are at rest with the ball 52 loaded in the barrel. Next, a user pulls the handle 40 rearward as represented by an arrow 70, FIG. 5. Along with the handle 40, the connected or engaged ram 42 and the abutted carriage 44 are also moved rearward, and the launch spring 48 is loaded by being extended rearward. After a predetermined extension of the launch spring, the handle, the ram and the carriage reach a predetermined location. At the predetermined location, an element causes the connector 46 to release the ram 42 from the handle 40, allowing the carriage, which is attached to the spring 48, to be rapidly accelerated forward. The carriage drives the ram forward. After separation the ram 42 and the carriage 44 move forward together as represented by the arrows 72, 74, FIG. 6, under the influence of the launch spring 48 toward the lever 50. The handle remains in the rearward position if the user continues to hold the handle. The carriage 44 only moves forward to its start position, as shown in FIG. 7, which may include impact with a bumper. The ram 42, however, which is slidable relative to the carriage, is able to continue forward motion as also depicted in FIG. 7, and as represented by the arrow 76. By sliding forward on its own, the relatively heavy and fast moving ram 42 is able to transfer considerable energy to the lever.

Figure 8:
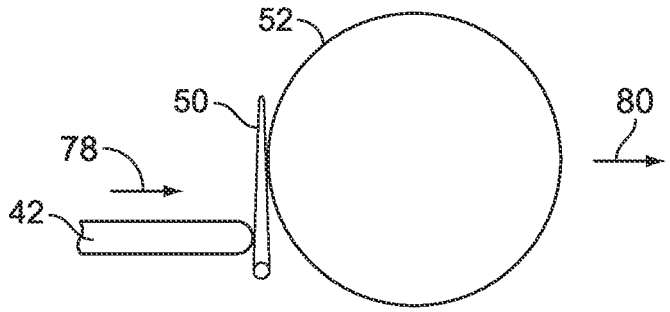
FIG. 8 is a diagrammatic side view of the ram impacting the lever and the lever slapping the ball.
Figure 9:
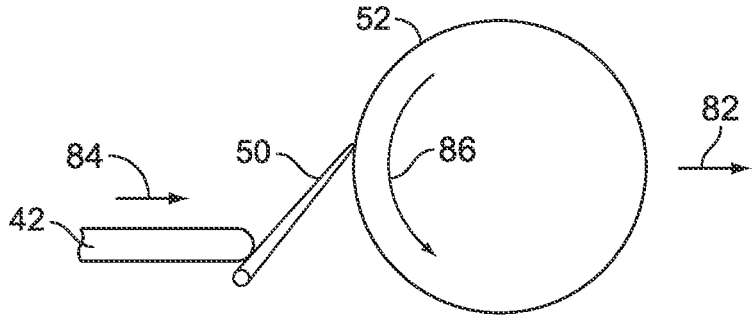
FIG. 9 is diagrammatic side view of the ram continuing to impact the lever, and the lever continuing to impact the ball to induce a backspin in the ball.
Figure 10:
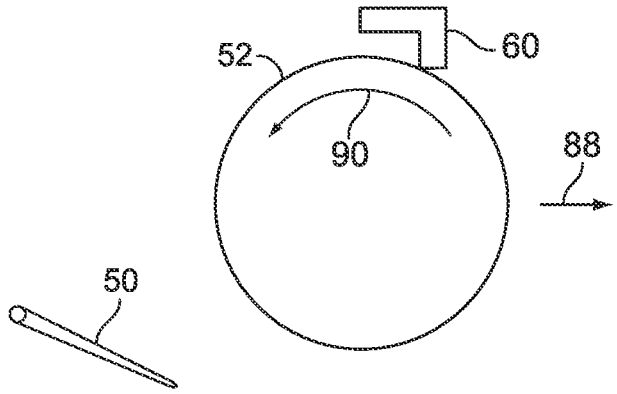
FIG. 10 is diagrammatic side view of the lever no longer in contact with the ball and the ball moving passed a backspin inducing protrusion.

The moving ram impacts or strikes the lever 50 at a location about two-thirds down from the top of the lever as again depicted in FIG. 7. An arrow 78, FIG. 8, represents movement of the ram as it impacts the lever. The impact engenders a force multiplier effect as the lever 50 slaps or smacks the ball 52, accelerating the ball to the right in the drawing, represented by the arrow 80. Energy transfer from the ram to the lever and then to the ball starts on impact of the ram with the lever and continues as the lever rotates clockwise as shown in FIG. 9. The ball continues to move to the right as represented by an arrow 82. It is noted that the ram 42 continues to transfer energy to the ball, as depicted by an arrow 84. The downward rotating motion of the lever also imparts a counterclockwise backspin in the ball as indicated by an arrow 86, in addition to a discharge force. After the ball separates from the lever and moves in the direction of an arrow 88, FIG. 10, the ball may pass and lightly contact a wiper 60 to enhance the counterclockwise backspin in the ball depicted by an arrow 90, because a frictional force component is engendered on the ball.

The launch lever continues to rotate clockwise until a lever return spring stops and reverses the direction of the lever. The lever is lightweight in comparison to the ram, and the return spring offers light resistance to the ram since only a small spring rate in needed to return the lever to its upstanding position. After ball discharges, the user may release the handle to allow the handle return spring to bring the handle forward to the position shown in FIG. 4, where the handle 40 may reengage the ram 42.

It is noted that throughout this disclosure, words such as "forward", "rearward", "upper", "lower", "front", and "rear", as well as like terms, refer to portions of the launcher apparatus as they are viewed in the drawings relative to other portions or in relationship to positions of the apparatus as it will typically be held and moved during play when operated by a user.

Figure 11:
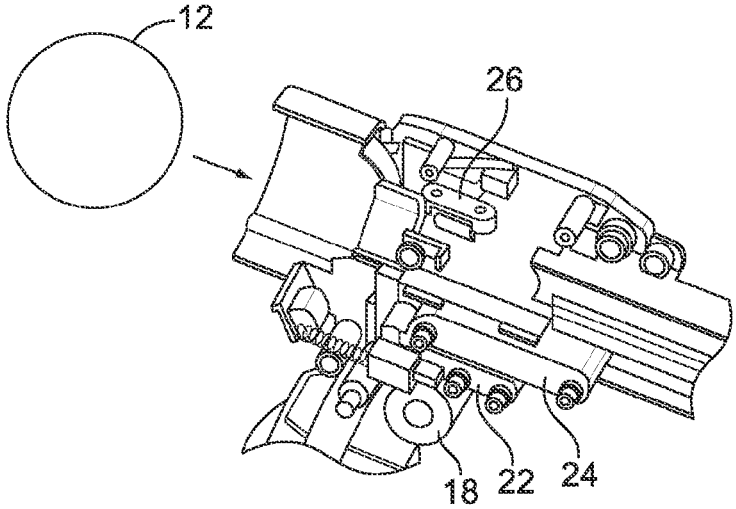
FIG. 11 is a partial isometric sectional view of the launcher apparatus being loaded with a ball.
Figure 12:
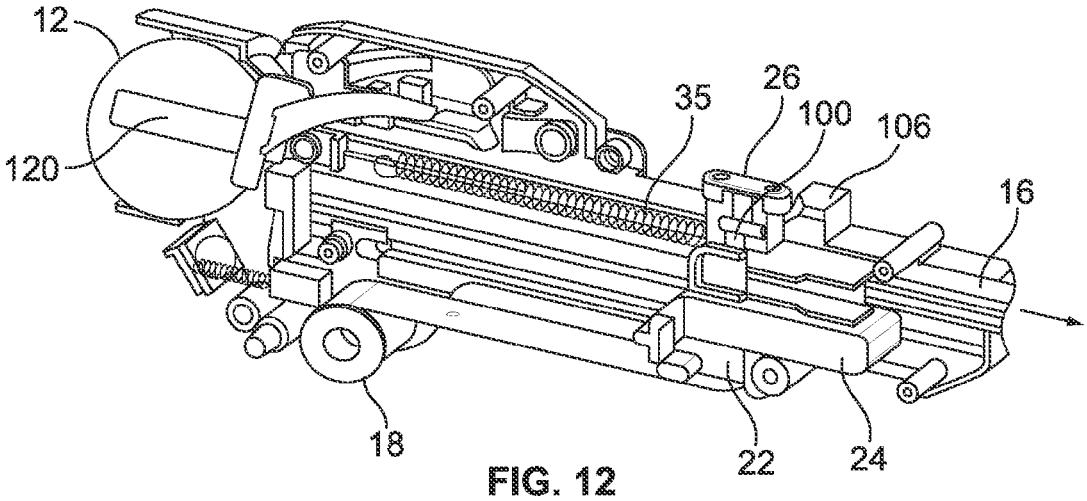
FIG. 12 is a partial isometric sectional view of the launcher apparatus illustrating the handle moving the ram and carriage rearward to a firing position.
Figure 13:
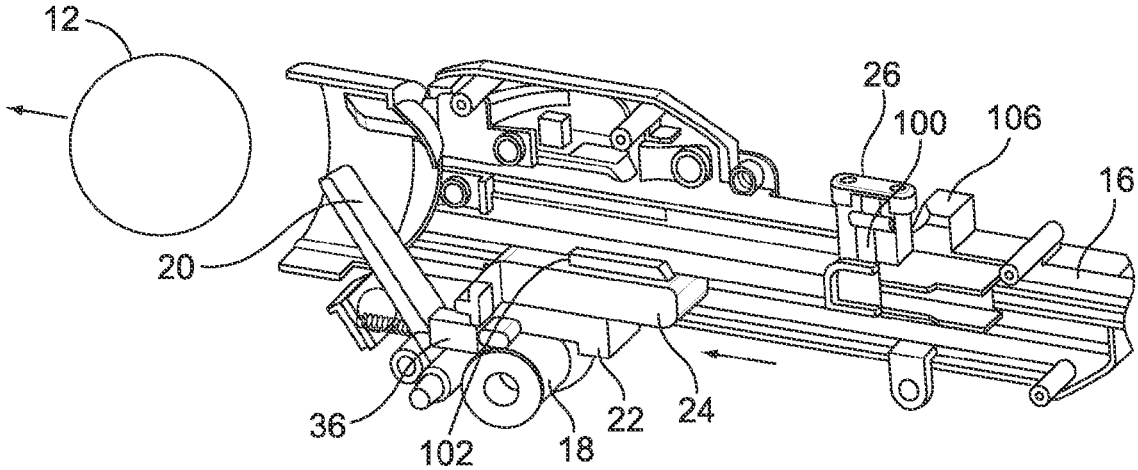
FIG. 13 is a partial isometric sectional view of the launcher apparatus illustrating the handle and connector at the firing position, the ram and the carriage in forward positions and the ball being discharged.
Figure 14:
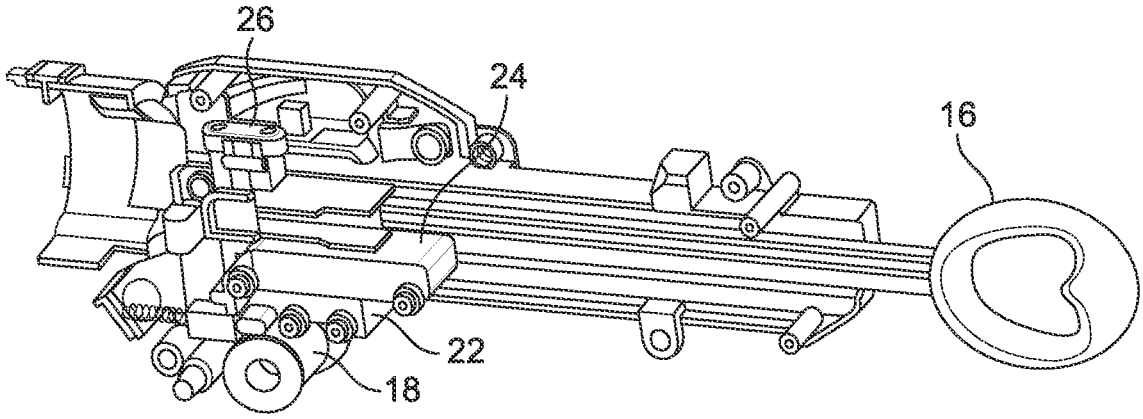
FIG. 14 is a partial isometric sectional view of the launcher apparatus illustrating the handle, the connector, the ram and the carriage after discharge of the ball.

In operation of the launcher apparatus 10, FIGS. 1-3 and 11-14, the proper ball 12, in size and perhaps weight, is inserted in a barrel 29 as shown in FIG. 11. Placing the ball in the barrel causes the connector 26, which includes a vertically slidable arm or pin 100, FIG. 2, to move between an upper position, shown in FIG. 2, and a lower position shown in FIG. 12. In the lower position the pin is located forward of the ram 24. When the handle 16 is moved rearward the pin connector 100 engages an abutment surface 102 of the ram 24 and pushes the ram rearward, as shown in FIG. 12. In turn, the ram moves the carriage 22 and extends the attached negator spring 18, also shown in FIG. 12. When the handle is moved rearward to a predetermined location, a ramp 104 on a protrusion 106, FIGS. 2, 12, and 13, cams the connector pin 100 upward so that the ram 24 as well as the carriage 22 are released from the handle 16, and the ram and carriage are able to move rapidly forward because of the biasing force of the negator spring as shown in FIG. 13. This operation may be considered automatic because firing or discharging of the launcher apparatus 10 shown in FIGS. 1-3 and 11-14, does not require any action of the user other than retraction of the handle 16. The carriage 22 stops at the bumper 36, however, the ram 24 continues to slide forward on its own to impact the lever 20, FIG. 13, causing the lever to slap the ball 12 resulting in discharge. The handle 16, FIG. 14, may then be released by the user to have it return forward under the influence of the return spring 35, FIG. 12, to the start position shown in FIGS. 2 and 14, where the handle is repositioned with the connector pin 100, the ram 24 and the carriage 22.

In the alternative, the ram and the carriage may be deleted and the handle may be made heavier and attached directly to the launch spring to operate like a slingshot. Other projectile shapes may be used instead of the ball, however, safety considerations are a concern. Size and weight may change as may the travel distance of the handle to more or less than about four to four and a half inches. Also the launch spring may have a pull force of more or less than about five pounds. The launcher apparatus may include, in the alternative, a projectile magazine, such as a cartridge, a cassette, a canister or a tube loaded with multiple projectiles.

Figure 15:
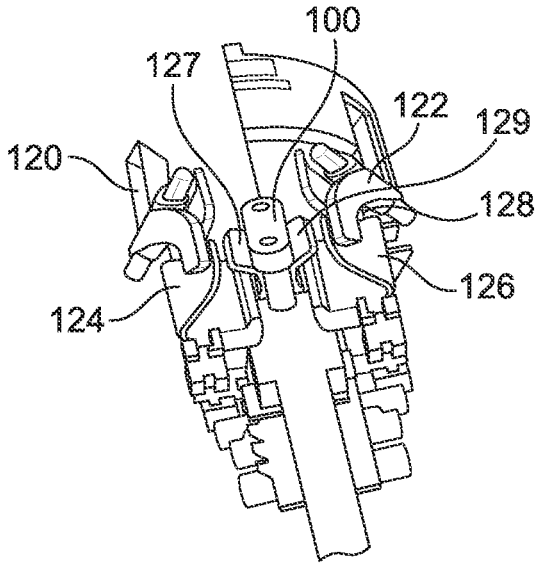
FIG. 15 is a partial isometric sectional view of the launcher apparatus illustrating arms and flanges for operating the connector.
Figure 16:
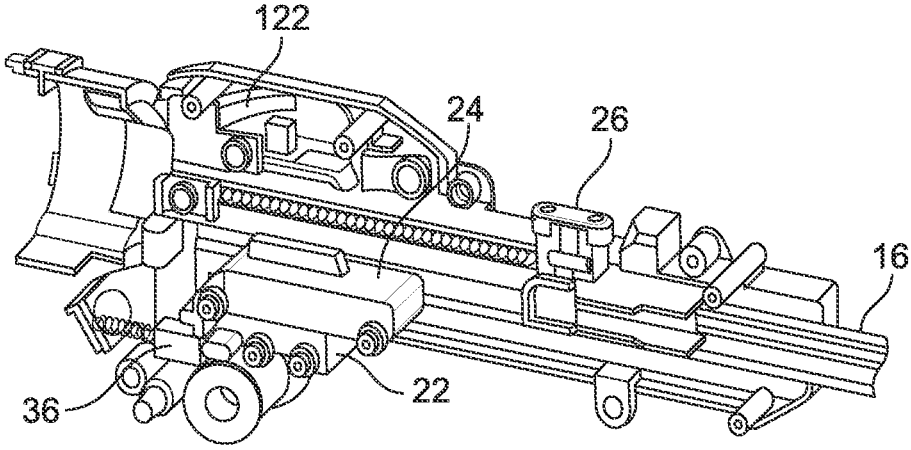
FIG. 16 is a partial isometric sectional view of the launcher apparatus illustrating firing elements when no ball is loaded where the ram and the carriage remain stationary when the handle is retracted.
Figure 17:
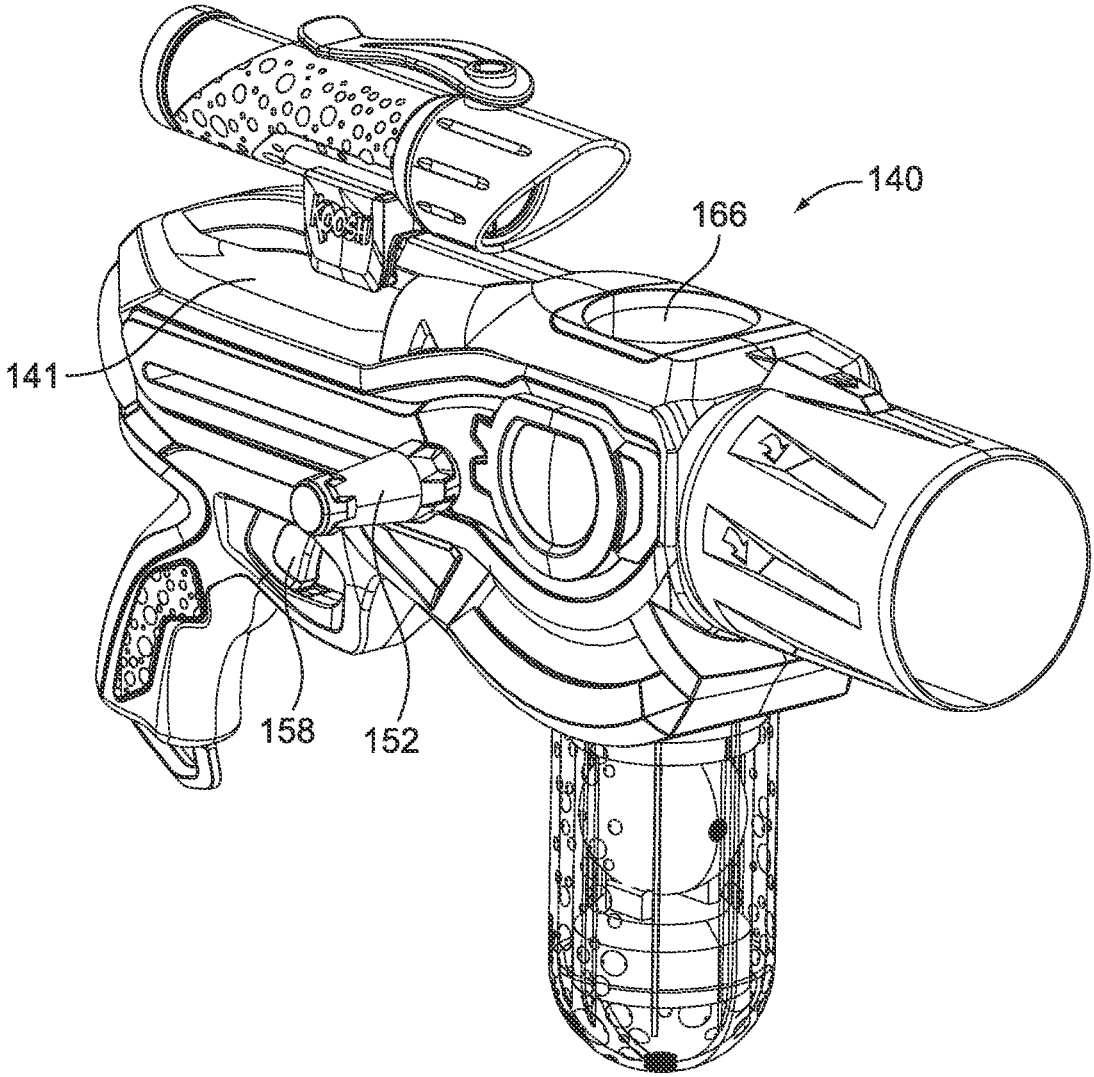
FIG. 17 is an isometric view of another embodiment of a launcher apparatus with an attached ball magazine beneath the apparatus, a side bolt handle and a trigger assembly.

Another important feature of the present invention, sometimes referred to as "simulation play," enables the apparatus 10 to be used without a ball or other approved projectile and yet users are able to role-play. The same mechanism that allows simulation play also provides a safety feature in that an attempt to load most items other than the ball mentioned above will alter the manner in which the launcher apparatus operates. Referring now to FIGS. 12, 15 and 16, the apparatus 10 includes a pair of pivotal ball contacting arms 120, 122, FIG. 15, that are mounted in the barrel 29 of the launcher apparatus. The ball arms 120, 122 are engagable with a mating pair of arrester arms 124, 126 that in turn engage flanges 127, 129 that operate the connector pin 100. The arrester arms 124, 126 are biased by springs, such as the spring 128, to hold the connector pin in the upper position where the connector pin remains out of engagement with the ram. When a ball is inserted into the barrel of the launcher apparatus, the ball forces rotation of the ball arms 120, 122 that in turn rotate the arrester arms 124, 126 away from engagement with the flanges 127, 129 so that the connector pin is no longer supported. The connector pin 100, biased by a spring 130, FIG. 2, is then able to drop to the lower position and abut the ram. Hence, when the handle is retracted the ram as well as the carriage move with the handle. However, if no ball is inserted into the barrel, or if an item that is smaller or differently shaped than the ball is inserted, the ball arms 120, 122 do not rotate and they do not disengage the arrester arms 124, 126 from the flanges of the connector pin. The result is that the connector pin does engage the ram with the handle and when the handle is retracted, and the ram and carriage do not move, as shown in FIG. 16. The handle may then be release in the usual way and the return spring 35 returns the handle to its start position. The feature of the launcher apparatus is that it may be operated in a similar manner whether or not a ball is loaded.

Referring now to FIGS. 17-20, another variation of the inventive launcher apparatus is shown in the form of a magazine fed toy gun 140. The toy gun 140 includes a housing 141, a ram 142, a carriage 144, a negator spring 146, a lever 148 and a ram latch bar lock 150. The toy gun also includes a sliding bolt handle 152, FIG. 17, located at the side of the toy gun instead of at the rear where the previously described handle was located for the embodiment shown in FIGS. 1-3 and 11-16. The toy gun additionally includes a half way lock 154 to enable loading of several balls into a magazine 156, a trigger assembly 158, a ball detector 160, a front gate 162 and a backspin pin 164. To operate the toy gun 140, a user pulls the bolt handle 152 rearward causing a link 163 to engage a ram surface 165. Rearward movement of the bolt handle results in both the ram and the carriage moving rearward because the nose portion of the ram engages the carriage when moving rearward as mentioned earlier. After the bolt handle has moved about half way, it is locked by the lock 154 from forward movement, allowing the user to load the magazine 156 with balls through an opening 166 in the top of the toy gun.

Figure 18:
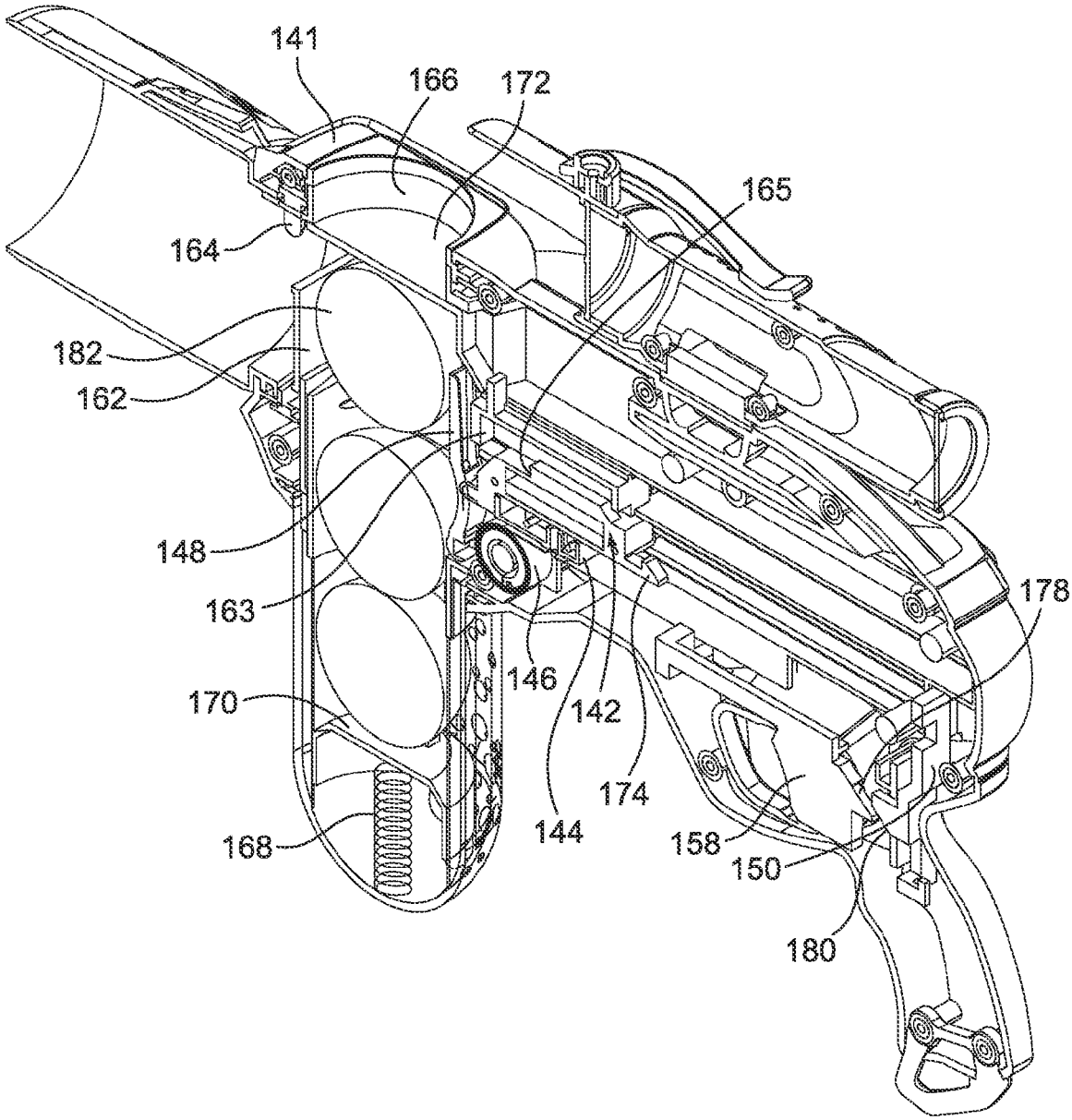
FIG. 18 is an enlarged isometric sectional view of the launcher apparatus shown in FIG. 17.
Figure 19:
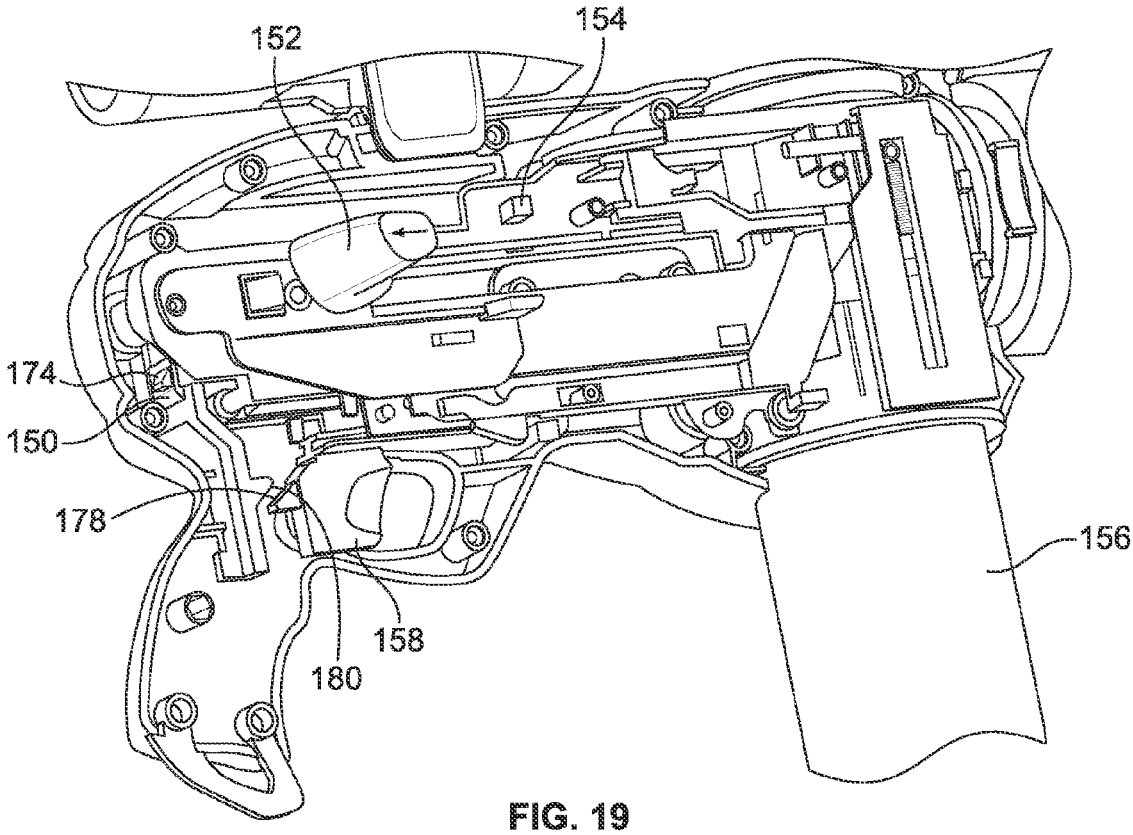
FIG. 19 is another isometric sectional view of the toy projectile launcher apparatus shown in FIG. 17, and illustrating a connector latching a ram in a rearward position.
Figure 20:
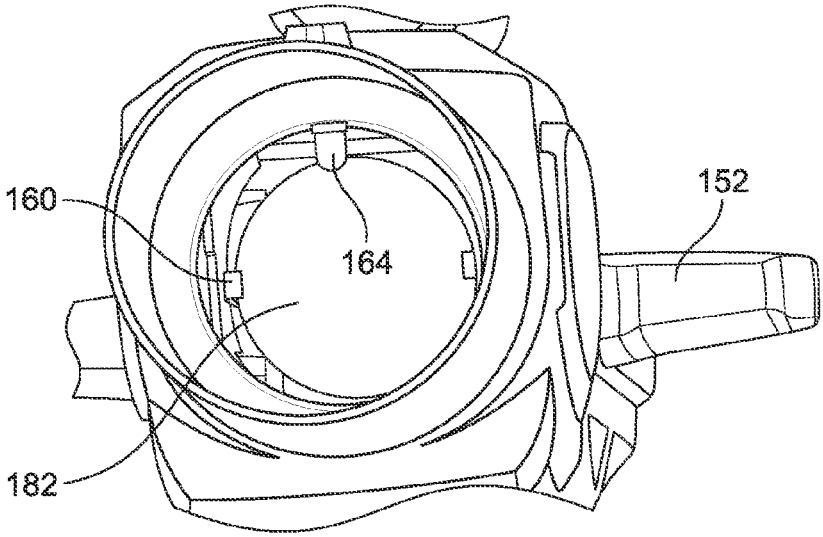
FIG. 20 is a front isometric view of the toy projectile launcher apparatus shown in FIG. 17, illustrating a backspin wiper.

The magazine 156 is a tube having a spring 168 and a spring cover 170 which bias the balls in the tube upward to a discharge position as shown in FIG. 18. A panel 172 at the top of the tube prevents the loaded balls from exiting the tube. Thereafter, the bolt handle may be moved fully rearward by the user and then fully forward. A series of locks, latches and safety mechanisms are activated and deactivated by the bolt handle movement. Unlike the earlier embodiment, the gun does not automatically fire when the cocking handle reaches a predetermined position. Instead, when the bolt handle is moved fully rearward, a predetermined location, a latch 174, which is part of the ram 142, is engaged by the spring-biased latch bar 150. A user must pull back the trigger assembly 158 causing a ramp 178 of the trigger assembly to push a ramp 180 of the latch bar lock upward. When the lock is lifted, the latch 174 is released, the carriage snaps forward under the influence of the biasing force of the negator spring 146, and the carriage takes the ram along. The ram strikes the lever 148, and the lever slaps an upper ball 182 causing discharge. The user must re-cock the gun to load the next ball and set up the ram and carriage again.

Figure 21:
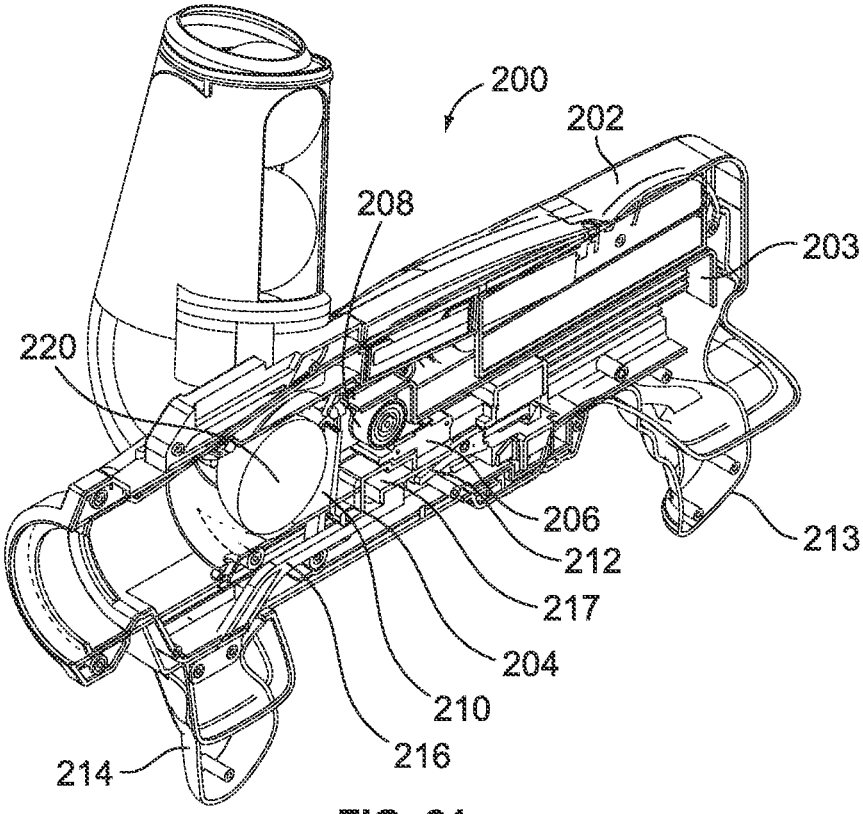
FIG. 21 is an isometric sectional view of still another embodiment of a launcher apparatus with a gravity fed ball magazine, and a sliding grip handle.
Figure 22:
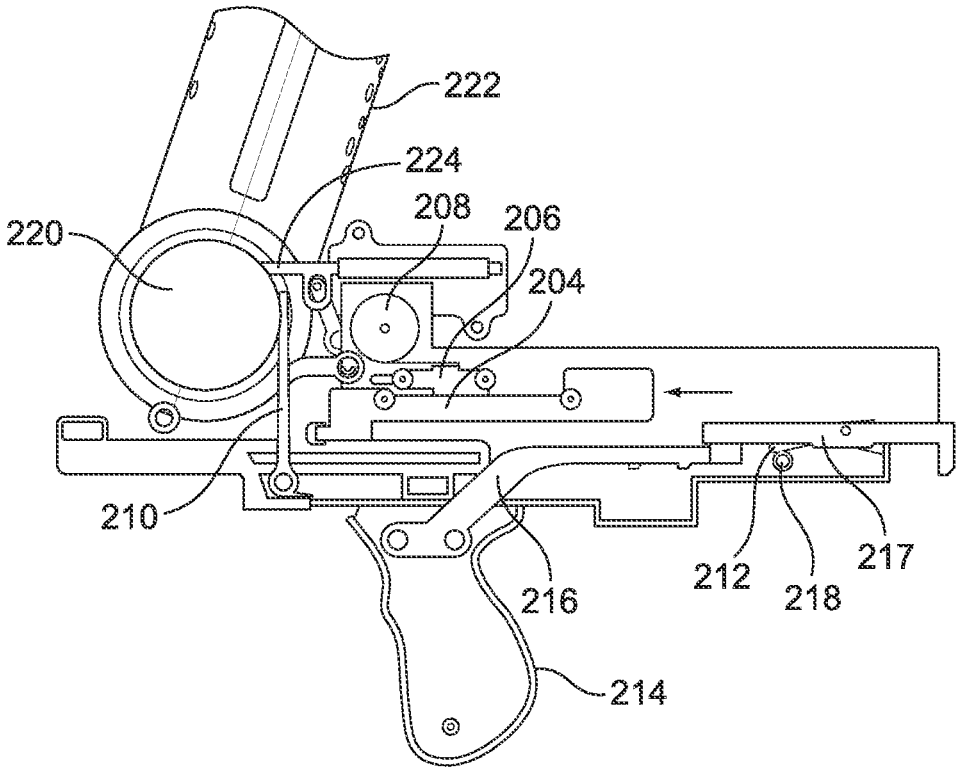
FIG. 22 is diagrammatic side view of the launcher apparatus shown in FIG. 21, illustrating an automatic release of a connector resulting in a ram and a carriage quickly moving forward under the biasing force of a negator spring toward a lever, and a pin blocking balls in the magazine.

Another variation is illustrated in FIGS. 21-22, in the form of a gravity fed toy gun 200. The gun includes the usual housing 202 with a frame 203, a ram 204, a carriage 206, a negator spring 208, a lever 210, a ram lock 212 and a control grip 213. Instead of a rear or side located handle as described previously, the toy gun 200 includes a grip handle 214 located beneath the housing 202 for cocking the gun. Like the first described embodiment shown in FIGS. 1-3 and 11-16, discharge is automatic once the handle is moved rearward to a predetermined location. When the grip handle 214 and links 216, 217 are moved rearward to a predetermined location, depicted by a circular protrusion 218, the ram lock 212 releases the ram 204 as depicted in FIG. 22, and the ram 204 along with the carriage snap forward to impact the lever 210 and discharge a ball 220. The toy gun 200 also includes a gravity feed magazine 222 and a blocking pin 224 that extends into the magazine when the grip handle 214 starts its rearward movement. After the ball is discharged and the grip handle returned to its full forward position by the user, the blocking pin 224 retracts to allow the next ball in the magazine to move to a discharge position in front of the lever. Additional features such as sound may be included to all of the embodiments to enhance play value. It is noted that the negator spring 208 is located above the carriage and the carriage is located above the ram unlike the embodiments mentioned above where the spring was beneath the carriage and the carriage was beneath the ram. Operation is the same with either arrangement.

Figure 23:
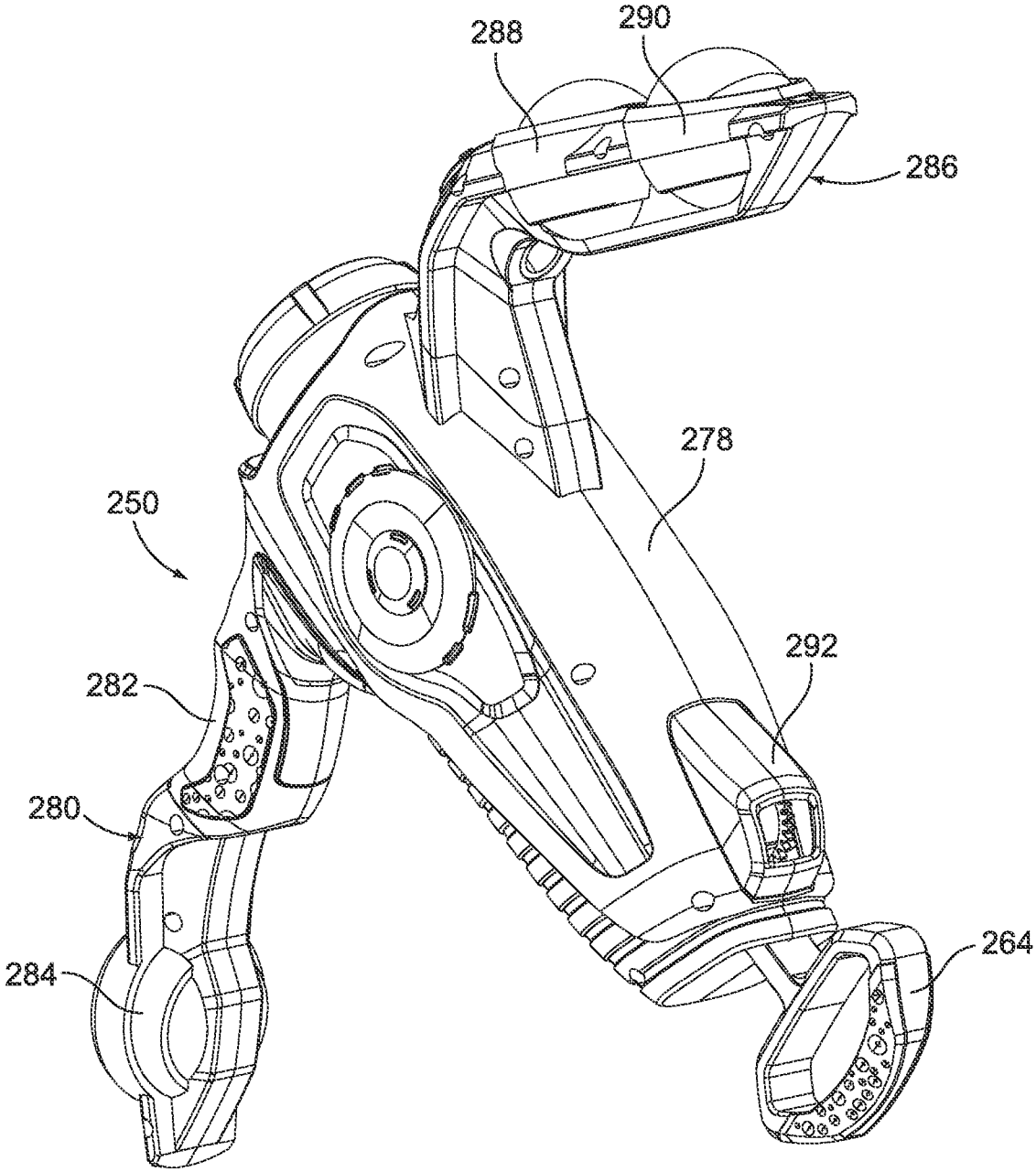
FIG. 23 is an isometric sectional view of yet another embodiment of a launcher apparatus in form of a bow shaped gun, a rear located handle and three ball storage locations.
Figure 24:
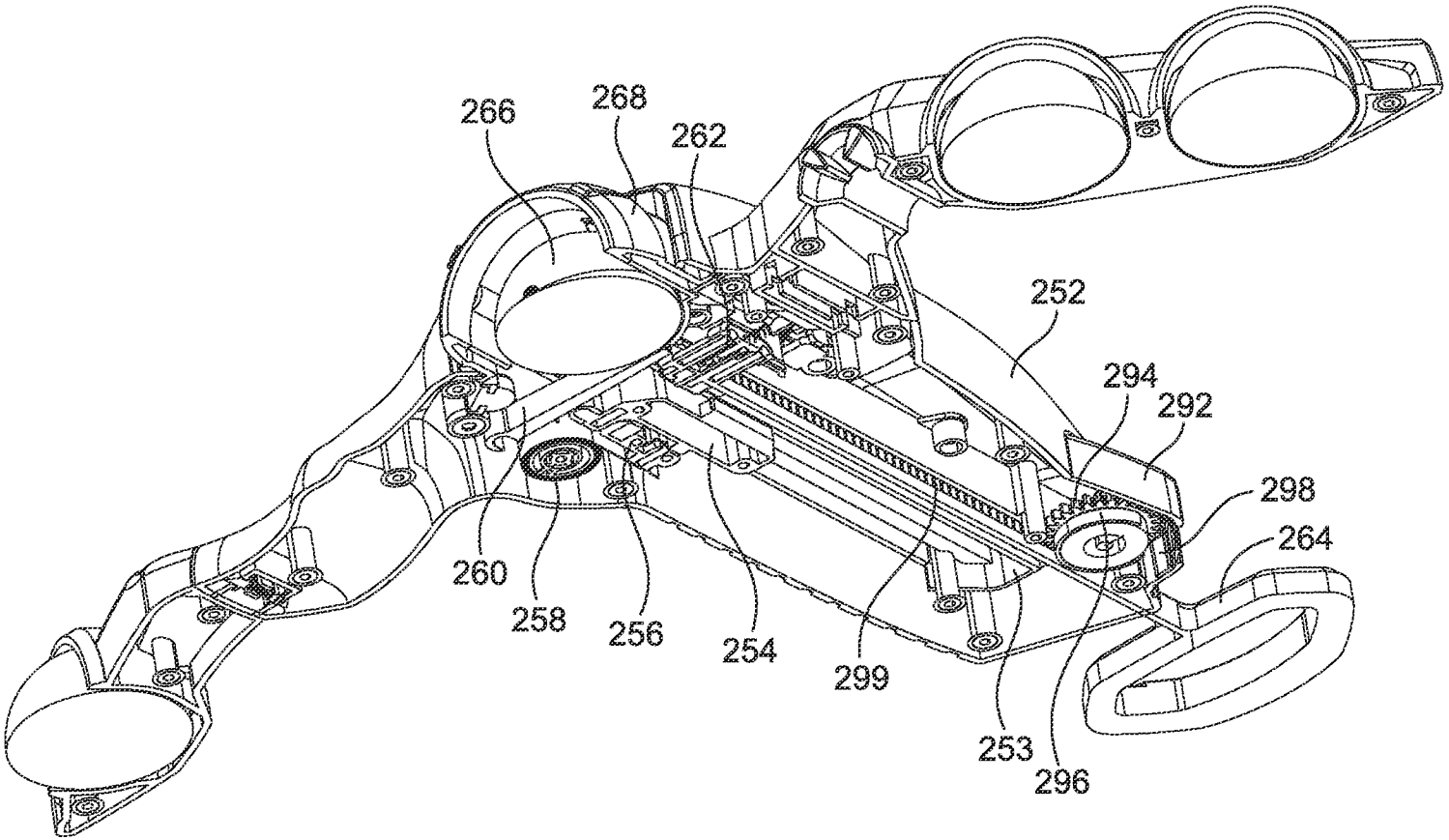
FIG. 24 is an isometric sectional view of the launcher apparatus shown in FIG. 23.
Figure 25:
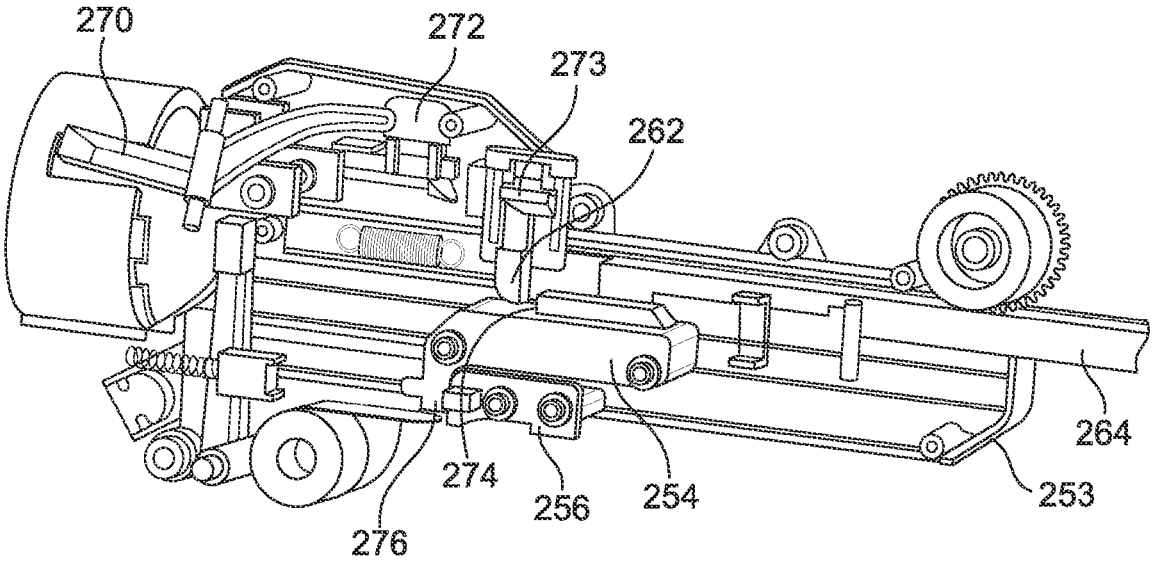
FIG. 25 is an isometric sectional view of the launcher apparatus shown in FIGS. 23 and 24, illustrating a handle and a connector engaging and moving a ram and a carriage rearward after a ball is loaded.
Figure 26:
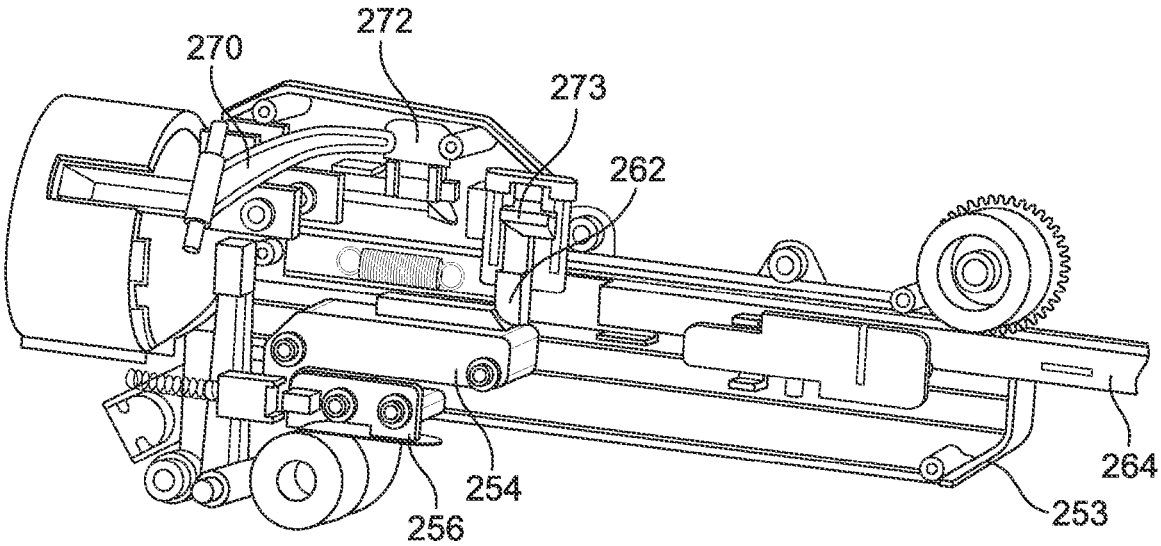
FIG. 26 is an isometric sectional view of the launcher apparatus shown in FIGS. 23-25, illustrating the handle and the connector moving rearward without the ram and the carriage because no ball has been loaded.

Continuing to illustrate the breath of the present invention, yet another variation is illustrated in FIGS. 23-26, in the form of a bow shaped toy gun 250. The bow gun 250 also includes a housing 252 with a frame 253, a ram 254, a carriage 256, a negator spring 258, a lever 260, a ram lock 262 and a handle 264. The firing elements are very similar to those in the embodiment described in detail and illustrated in FIGS. 1-3, and 11-16, where the toy gun 10 may be used with or without a loaded ball. The bow gun 250 automatically releases the ram 254 when the handle 264 reaches a predetermined location, such as after the handle is fully retracted and then returned partway forward. However, if no ball is loaded or the wrong projectile is used in the bow gun, the handle 264 may still be retracted in the usual manner, but the ram and carriage do not engage the ram lock and do not move rearward, resulting in no discharge. If a ball 266, FIG. 24, is loaded in the barrel 268, a linkage of two pairs of arms and two flanges, such as the arm 270, FIG. 25, the arm 272, and the flange 273, allow the ram lock 262 to descend and engage an abutment surface 274 on the ram 254 such that the ram and the carriage are moved rearward, the nose portion 276 of the ram abutting the carriage 256, when the handle 264 is pulled rearward. If no ball is loaded or an item that is an incorrect size is loaded, the linkage arms do not release the ram lock until the handle is retracted beyond the ram, as shown in FIG. 26, so that the ram does not engage the ram lock and the ram 254 and the carriage 256 do not move.

The bow gun 250 includes a fuselage portion 278, FIG. 23, and two wings or arms, a lower arm 280 having a grip portion 282 and a ball storage slot 284, and an upper arm 286 having two ball storage slots 288, 290. The bow gun may include another feature called a power meter 292. The meter 292 may include a geared inner roller 294, FIG. 24, an outer roller 296 and a display 298. The handle 264 may also be geared 299 and may engage the inner roller 294. As the handle is retracted the inner roller rotates until the handle is retracted a predetermined distance, such as seventy five to eighty millimeters. At that distance the outer roller 296 begins to rotate to indicate the distance of retraction to the user. The handle displacement may be translated to power or discharge force, namely, the force available from the negator spring to cause ball discharge. The further rearward the handle is moved, up to about one hundred and fifteen millimeters, the greater will be the force of discharge and the further the discharged ball will travel. To inform the user, the meter display 298 may indicate three degrees of power: "zero," "half" and "max."

Figure 27:
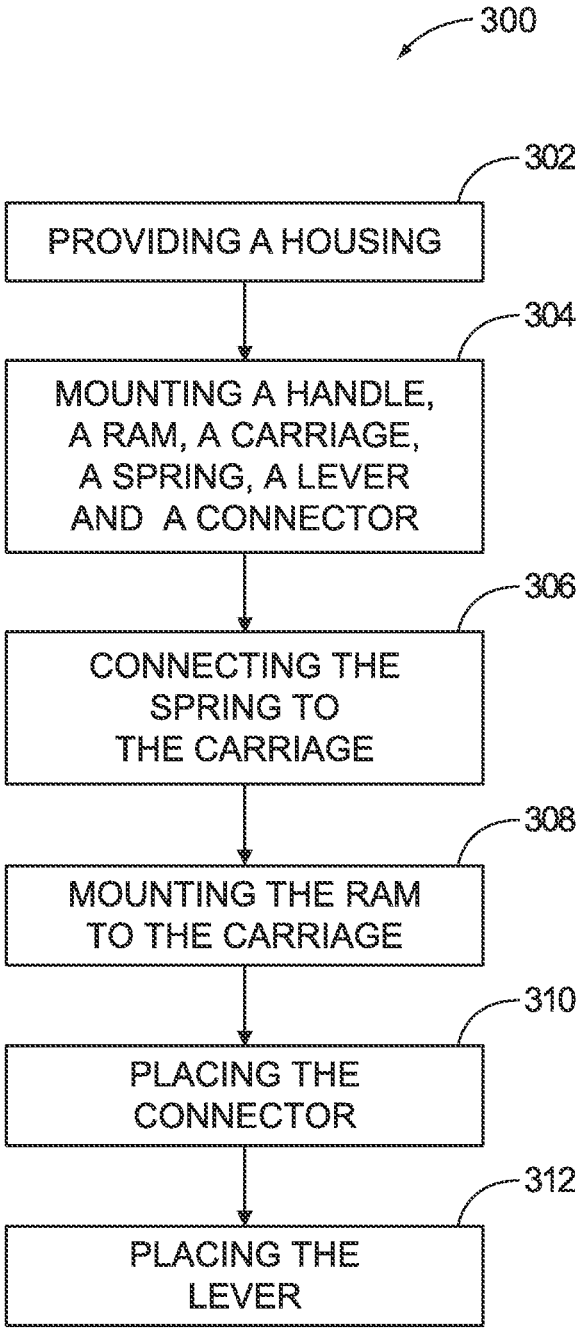
FIG. 27 is a flow diagram for a method of making the toy projectile launcher apparatus of the present invention.

The present invention also includes a method for making a toy projectile launcher apparatus 300, FIG. 27, capable of discharging a lightweight ball, the steps including providing a housing 302, mounting a handle, a ram, a carriage, a spring, a lever and a connector to the housing 304, connecting the spring to the carriage 306, slidably mounting the ram to the carriage 308, placing the connector 310 to engage the ram when the spring is extended and to disengage the ram to enable the ram and the carriage to quickly moving under the influence of the spring, and placing the lever so as to be impacted by the moving ram 312, the impacted lever being able to rotate and slap the ball resulting in the ball's discharge.

The toy projectile launcher apparatus disclosed in detail above has great play value, is fun to use and easy to operate in a safe manner, even for younger children, and yet the launcher apparatus has a robust, but simple structure, that may be produced at a reasonable cost.

From the foregoing, it can be seen that there has been provided features for an improved toy launcher apparatus and a disclosure for the method of the making the toy. While particular embodiments of the present invention have been shown and described in detail, it will be obvious to those skilled in the art that changes, modifications and other variations may be made without departing from the invention in its broader aspects. Therefore, the aim is to cover all such changes, modifications and variations as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A projectile launcher apparatus comprising:

a housing;

an extending and retracting launch spring mounted to the housing, the launch spring for providing discharge energy when retracting to eject a projectile;

a lever pivotally connected to the housing;

a ram movable with the launch spring when the launch spring is extending, and the ram being driven by the launch spring when the launch spring is retracting, the ram for impacting the lever and causing the lever to impact the projectile; and a handle mounted to the housing, the handle for extending the launch spring.

2. The launcher apparatus of claim 1, including:

a latch connected to the ram and a spring biased latch bar connected to the housing; and a trigger mounted to the housing for moving the latch bar out of engagement with the latch.

3. The launcher apparatus of claim 1, including:

a spring biased arm and an abutment surface on the ram.

4. The launcher apparatus of claim 3, including:

a first arm mounted to the housing located to be engaged by a projectile for moving the first arm from a first position to a second position; and a second arm in engagement with the first arm for moving the second arm from a first position to a second position when the first arm moves to its second position; and wherein the spring biased arm is movable between first and second positions and includes a flange for engagement with the second arm to move the spring biased arm to its second position when a projectile moves the first arm to its second position.

5. The launcher apparatus of claim 4, wherein:

the spring biased arm in its second position is adjacent the abutment surface of the ram; and when the handle moves rearward, the spring biased arm moves the ram rearward.

6. The launcher apparatus of claim 5, including:

a ramp mounted to the housing at a predetermined rearward location for moving the spring biased arm to its first position to cause the spring biased arm to disengage from the abutment surface of the ram.

7. The launcher apparatus of claim 6, wherein:

the disengagement of the spring biased arm from the abutment surface of the ram occurs when the handle is at its rearward position.

8. The launcher apparatus of claim 6, wherein:

the disengagement of the spring biased arm from the abutment surface of the ram occurs when the handle is returning to its forward position.

9. The launcher apparatus of claim 1, including:

a carriage connected to the launch spring and the ram, the carriage being movable with the launch spring.

10. The launcher apparatus of claim 1, including:

a backspin protrusion mounted to the housing in the path of a discharging projectile for causing a backspin of the projectile.

11. The launcher apparatus of claim 1, including:

a lever return spring mounted to the lever for rotating the lever to an upright position.

12. The toy launcher apparatus of claim 1, wherein:

the handle assembly includes a handle return spring.

13. A launcher apparatus comprising:

a housing including an interior frame;

a launch spring mounted to the housing for providing discharge energy to eject a projectile, the launch spring being movable between relaxed and extended positions;

a handle mounted to the housing and movable between forward and rearward positions wherein in the rearward position the launch spring is extended;

an upstanding lever pivotally connected to the housing frame;

a carriage connected to the launch spring and the handle, and movable with the handle when the handle is moved to its rearward position;

a ram movable with the handle and the carriage when the handle is moved to its rearward position, the ram movable with the carriage when the carriage moves with the launch spring from the extended position to the relaxed position, and the ram slidably connected to the carriage for impacting the lever and causing the lever to pivot and hit the projectile; and a connector for releasably holding the ram.

14. The launcher apparatus of claim 13, including:

a linkage mounted to the housing and movable by a loaded projectile to engage a connector and the ram.

15. The launcher apparatus of claim 14, wherein:

the linkage prevents the connector from engaging the ram when no projectile is loaded.

16. The launcher apparatus of claim 15, including:

a lever return spring mounted to the lever for rotating the lever to the upstanding position; and a return spring mounted to the housing and to the handle for moving the handle from the rearward position to the forward position.

17. The launcher apparatus of claim 16, including:

a backspin protrusion mounted to the housing in the path of a discharging projectile for causing a backspin of the projectile.

18. A method for making a toy launcher apparatus capable of discharging spherical projectiles, the steps of the method comprising:

providing a housing;

mounting a handle, a ram, a carriage, a spring, a lever and a connector to the housing wherein the spring provides discharge energy to eject a projectile;

connecting the spring to the carriage;

slidably mounting the ram to the carriage;

placing the connector to engage the ram when the spring is extended and to disengage the ram to enable the ram and the carriage to quickly move under the influence of the spring; and placing the lever so as to be impacted by the moving ram, the impacted lever being able to rotate and hit a spherical projectile resulting in the projectile's discharge from the launcher apparatus.

19. The method of claim 18, including the step:

mounting a linkage to the housing and to the connector to engage the connector with the ram when a projectile is loaded in the launcher apparatus.

20. The method of claim 19, wherein;

the spring is a constant force spring.

* * * * *